US006743070B1

(12) United States Patent
Lin

(10) Patent No.: US 6,743,070 B1
(45) Date of Patent: Jun. 1, 2004

(54) WHIPPING TOP BASED BUBBLE TOY

(76) Inventor: Mon-Sheng Lin, 5th Floor, No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 10/372,959

(22) Filed: Feb. 26, 2003

(51) Int. Cl.[7] ..... A63H 1/00

(52) U.S. Cl. ..... 446/256; 446/259; 446/267; 446/15

(58) Field of Search ..... 446/256, 15, 21, 446/236, 239, 242, 243, 244, 246, 259, 264, 266, 267

(56) References Cited

U.S. PATENT DOCUMENTS 114,781 A * 5/1871 Eley ..... 446/176
2,375,986 A * 5/1945 Gandy ..... 446/259
2,394,093 A * 2/1946 Nalle, Jr. ..... 446/256
3,018,584 A * 1/1962 Passariello ..... 446/259
4,129,961 A * 12/1978 Parodi ..... 446/261
4,932,918 A * 6/1990 Onoda ..... 446/260

* cited by examiner

*Primary Examiner*—Jacob K. Ackun
*Assistant Examiner*—Bera B. Miller
(74) *Attorney, Agent, or Firm*—Troxell Law Offices PLLC

(57) ABSTRACT

A whipping top based bubble toy includes at least a whipping top, a fluid tube, a bracket board and a pull rod in which the whipping top, a conic block, has a central post to be mounted with sleeve and a ground tip. The bracket board has a vertical opening to receive the protruded sleeve from the whipping top and a transverse go-through aperture to house the rack which meshes the pinion gear installed in the bracket board. The whipping top forms a hollow vessel to be filled with bubble fluid. Aside from the whipping function, the whipping top also produces the bubbles.

4 Claims, 8 Drawing Sheets

WHIPPING TOP BASED BUBBLE TOY

FIELD OF THE INVENTION

This invention relates to a whipping top based bubble toy, in particular, the hollow vessel formed in the whipping top is utilized at best to be filled with the bubble fluid to achieve multiple functions.

BACKGROUND OF THE INVENTION

The whipping top available on the market performs a single function which draws a short time, but not an everlasting interest of the children, after a while, the children loss the interest and set it aside. If the whipping top is improved by adding a pull rod which acts as a gear rack to mesh with the pinion gear inside the whipping, throwing it out at a designed direction, it produces a combination to draw new interest for children to play with.

SUMMARY OF THE INVENTION

The whipping top based bubble toy of this invention mainly consists of a whipping top, a fluid tube, a bracket board and a pull rod. The whipping top forms a hollow vessel to be filled with bubble fluid, a through bottleneck to receive the fluid tube and an outer sleeve arranged with pinion gear to mesh with the teeth of the gear rack on the pull rod. The go-through opening in the bracket board permits inserting the pull rod in either direction in the bracket board so the teeth on the gear rack of the pull rod will mesh the pinion gear on the sleeve of the whipping top.

Aside from the self-spindling of whipping top, the main object of this invention is provide a bubble blowing, so it become a multiple purpose toy to promote the great interest of children.

Another object of this invention is to diversify the whipping top based bubble toy by attaching counter weight and other accessories.

DETAILED DESCRIPTION OF THE PREFERRED EMBODIMENT

Figure 1:
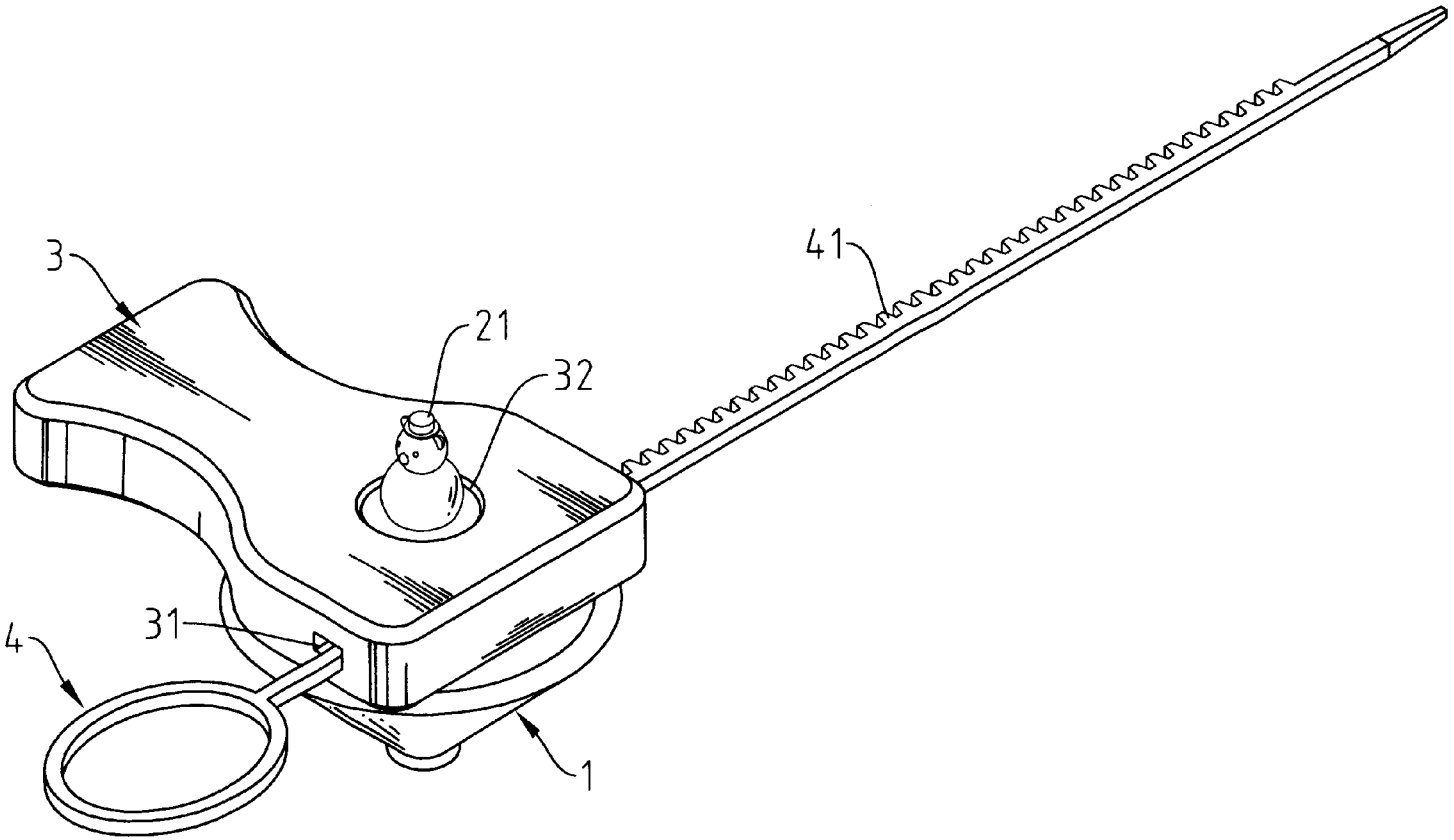
FIG. 1 is an outlook of a whipping top based bubble toy of this invention.

The configuration, operation and features of this invention will be discussed in great detail with the aid of embodiments as illustrated in the drawings attached.

Figure 2:
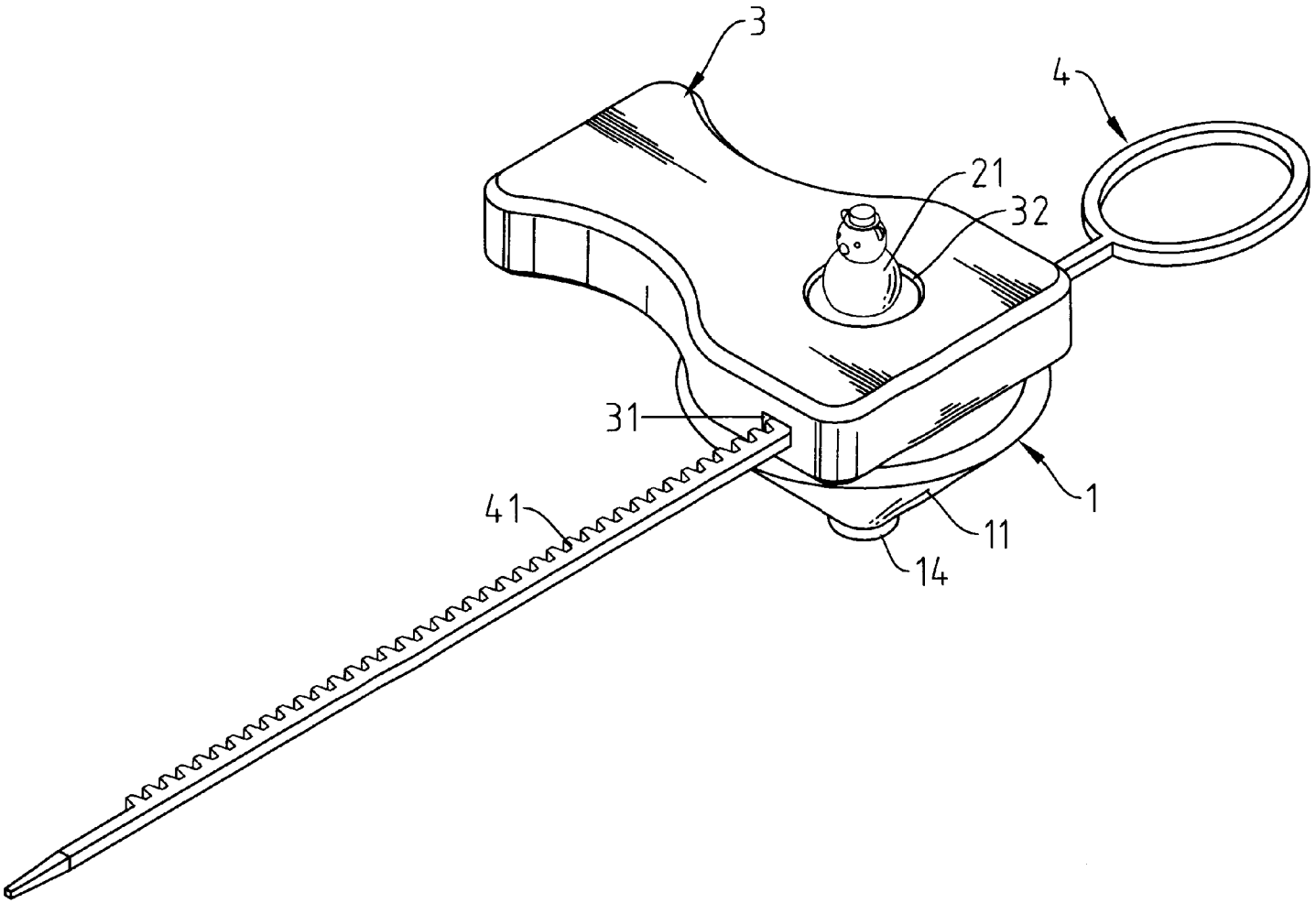
FIG. 2 is also a side outlook of a whipping top based bubble toy of this invention.
Figure 3:
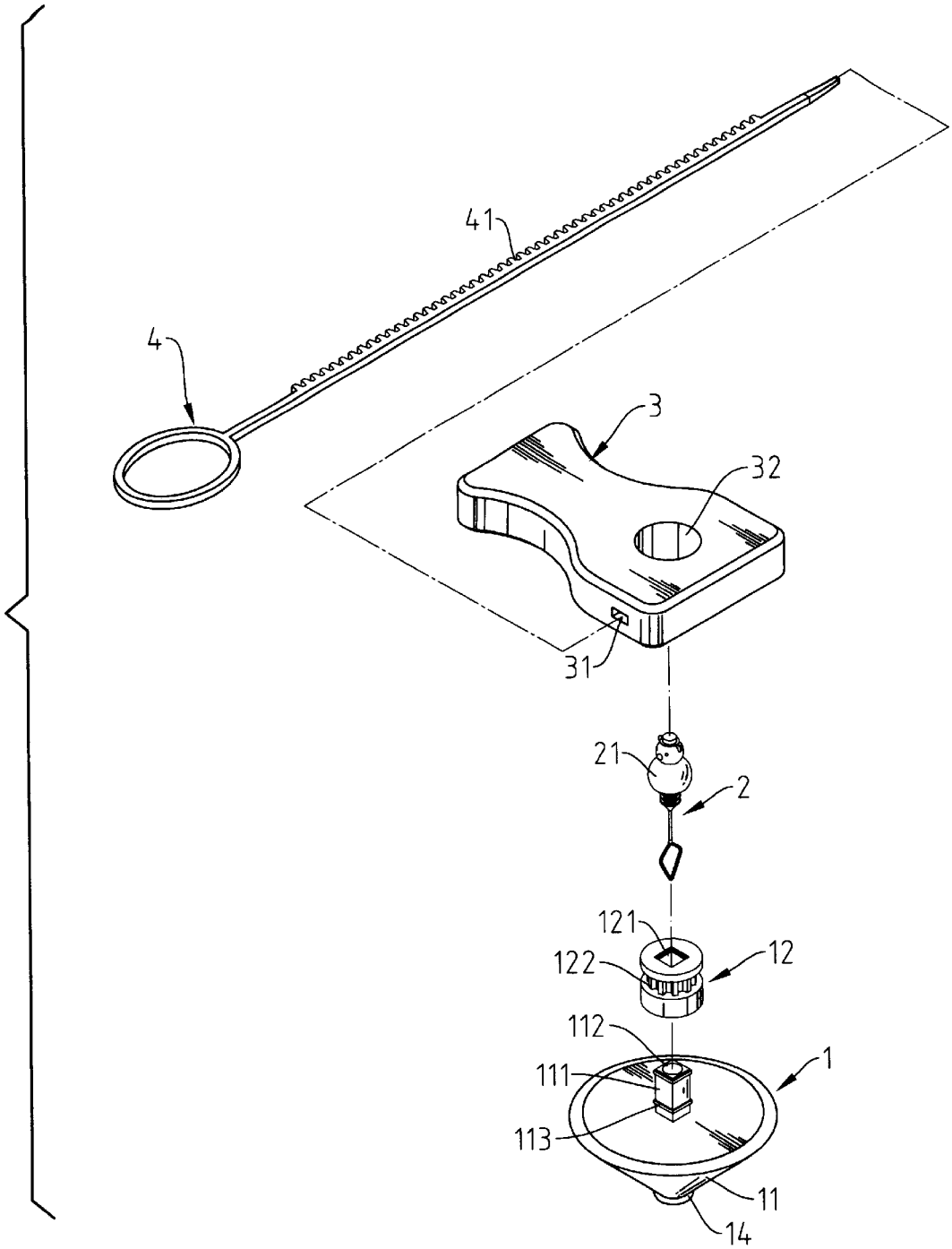
FIG. 3 is a disassembly of a whipping top based bubble toy of this invention.
Figure 4:
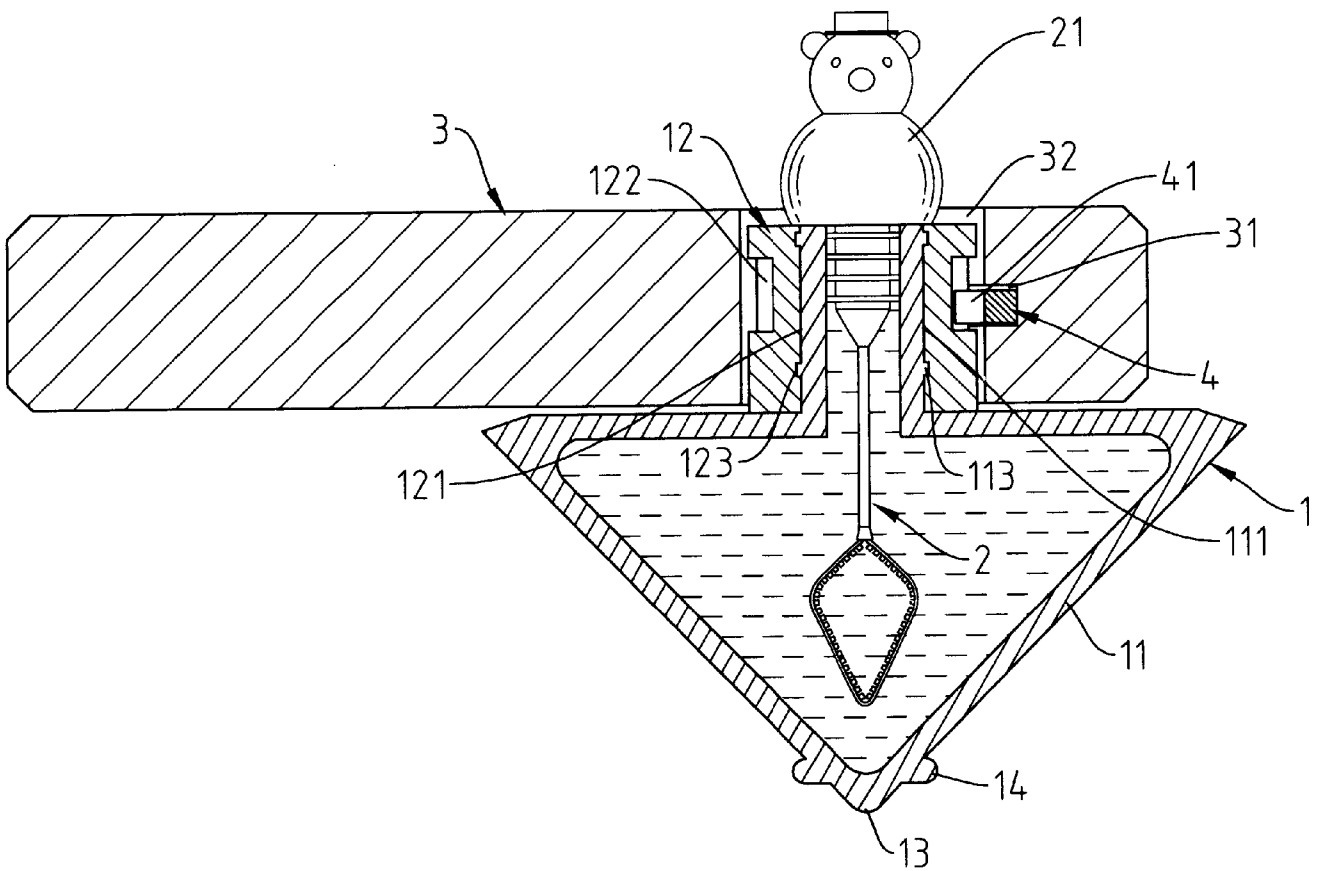

As shown in FIGS. 1 through 3, the whipping top based bubble toy of this invention mainly comprises a whipping top 1, a fluid tube 2 with a figure 21, a bracket board 3 and a pull rod 4. The whipping to 1 is a conic taper, with a top sleeve 12 and a ground tip 13. The bracket board 3 has a go-through vertical slot 32 and a go-through transverse opening 31 where the vertical slot 32 of the bracket board 3 will receive the top sleeve 12 of the whipping top 1 and the transverse opening 31 will accept the pull rod 4 with gear rack 41 which will mesh closely with the teeth 122 on the top sleeve 12.

Please refer to FIGS. 1 through 4; the interior of the whipping top 1 is a hollow vessel 11 to be filled with the bubble fluid. The whipping top 1 has an upright post 111 in multi-angular shape for easy connection with the aperture 121 of the top sleeve 12. The upright post 111 provides the male thread 113 on the rim and the bottleneck 112 on the upper top to receive the fluid tube 2. In addition to the multi-angular connection between the top sleeve 12 and the upright post 111, there is another connection in which the sleeve 12 further furnishes the female thread 123 on the inner wall to fit the male thread 113 on the upright post 111. The outer wall of top sleeve 12 provides the pinion gear 122. Since the bracket board 3 is tooth-free, it can be combined with the whipping top 1 in any direction, and the pull rod 4 can be inserted into transverse opening 31 of the bracket board 3 in any direction to mesh the pinion gear 122 on the top sleeve 12, so the whipping top 1 can be thrown out at any direction instead of one direction as does the prior art of whipping top 1.

Figure 5:
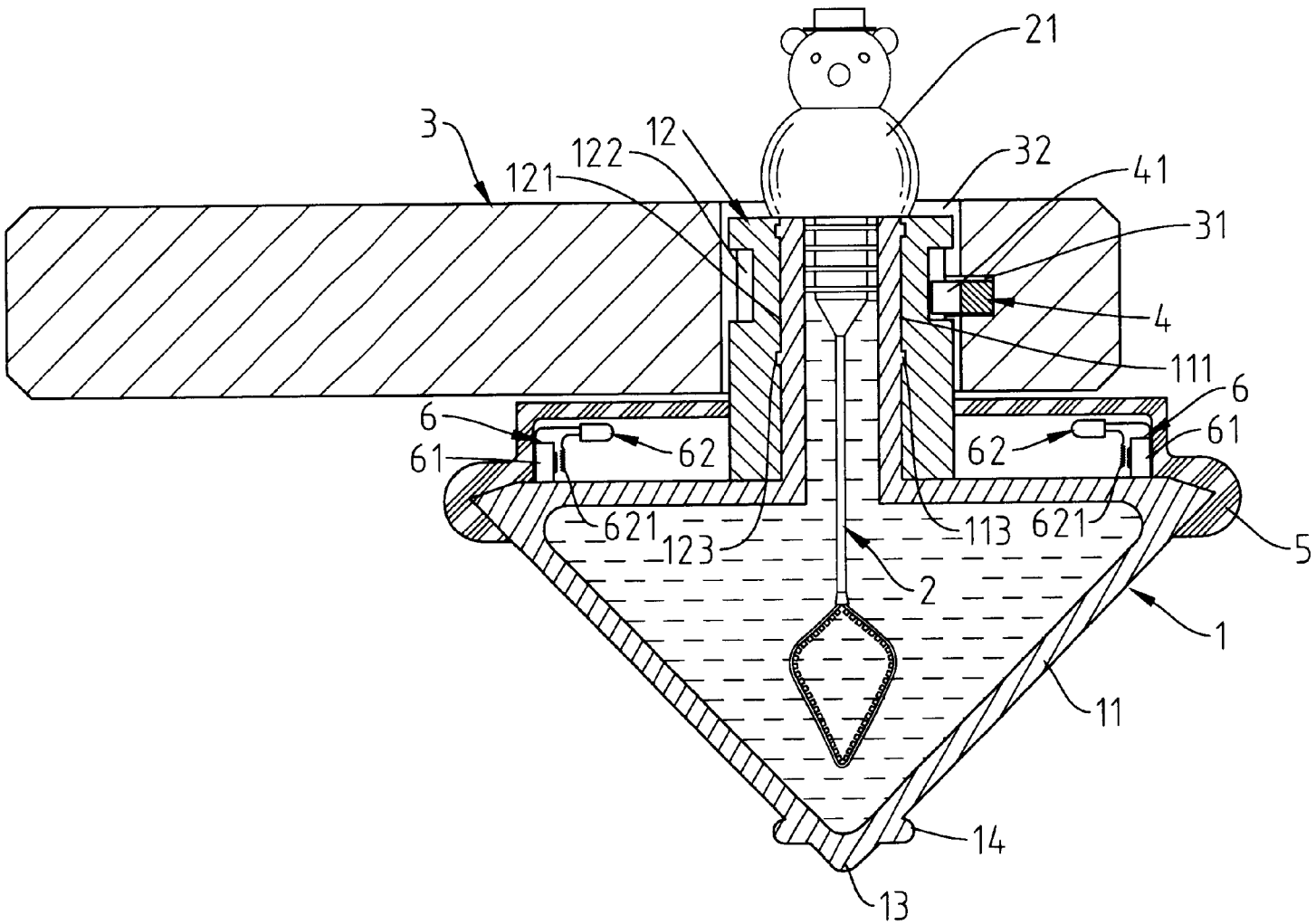
FIG. 5 is a cross-section of a whipping top based bubble toy of this invention.

As shown in FIG. 5, a protective shield 5 is outfitted between the upper part of the whipping top 1 and the top sleeve 12 to guard the whipping top 1 against scratch and abrasion. There is a chamber formed between the whipping top 1 and the protective shield 5 to house the illuminator 6. The illuminator 6 contains a battery 61 and LED 62. By the centrifugal force generated in rotation, the wire 621 will frequently contact the battery 61, so the LED 62 will emit colorful light while the whipping top 1 is running.

Figure 6:
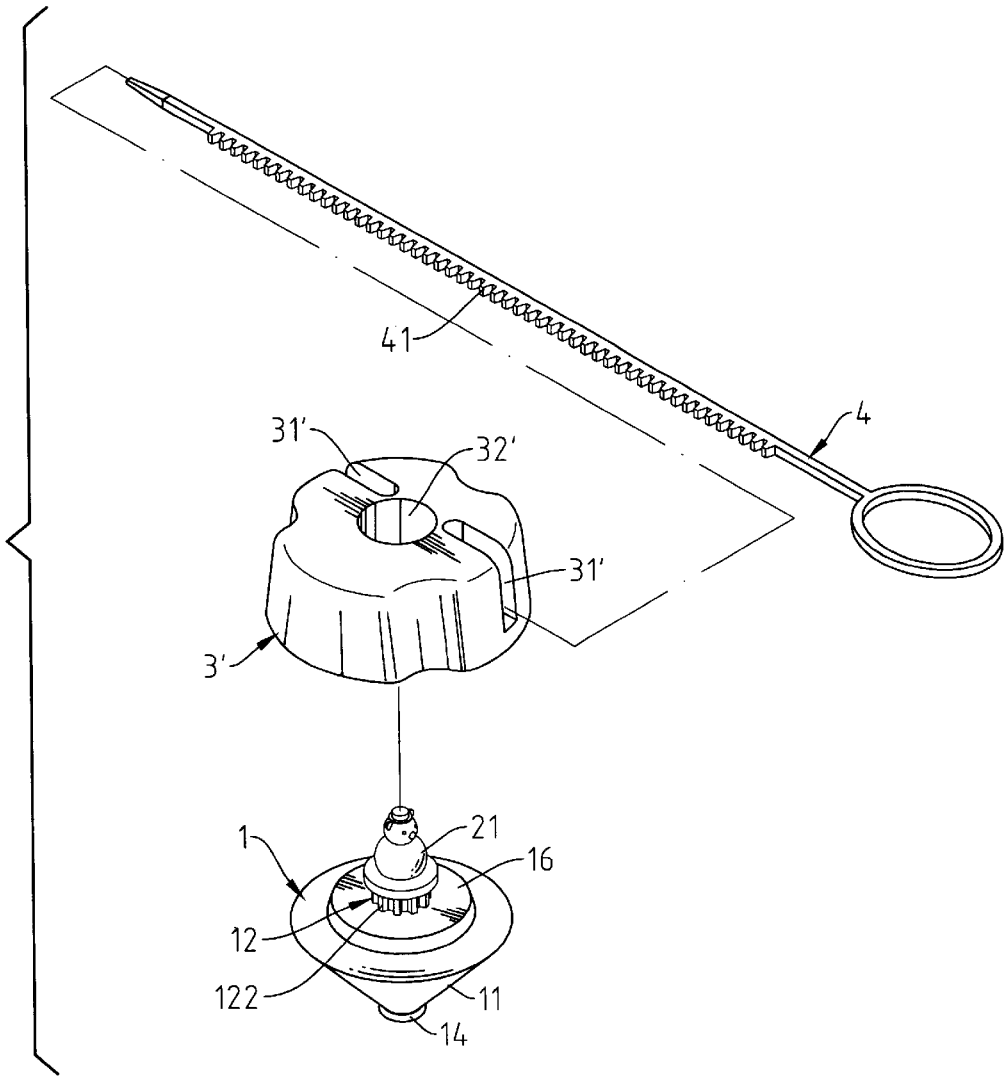
FIG. 6 is another embodiment of a whipping top based bubble toy of this invention.

As shown in FIG. 6, it is a modified embodiment of the bracket board 3' which has the vertical central slot 32' and transverse opening 31'. To ensure a better contact of bracket board 3' with the whipping top 1, a round board 16 is mounted under the pinion gear 122 of the top sleeve 12.

Figure 7:
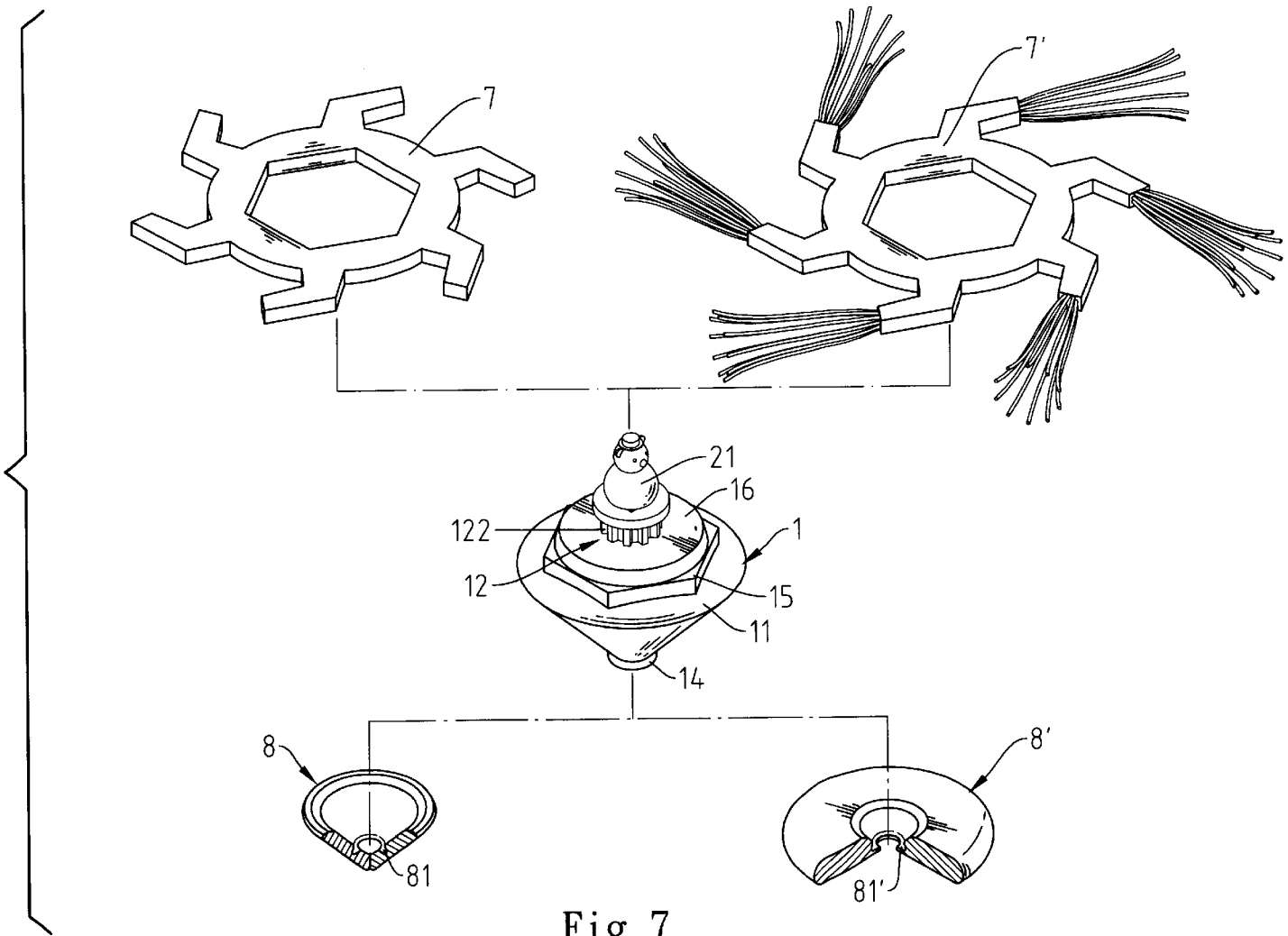
FIG. 7 is another embodiment of a whipping top based bubble toy of this invention.

As shown in FIG. 7, to superimpose more fun and interest to the whipping top base bubble toy, the accessories 7, 7' and counter weights 8, 8' are added to the hexagonal board 15 under the sleeve 12 of the whipping top 1. To ensure better contact, a plain board 16 is connected under the pinion gear 122 of the sleeve 12. The accessories 7, 7' are locked in the hexagonal board 15 the counter weights 8, 8' are locked on the bottom concave ring 14 of the whipping top 1 by means of catches 81 and 81' in an effort to lower the whipping gravity of the whipping top 1 and to gain great balance. The accessories 7, 7' and the counter weights 8, 8' are optional.

Figure 8:
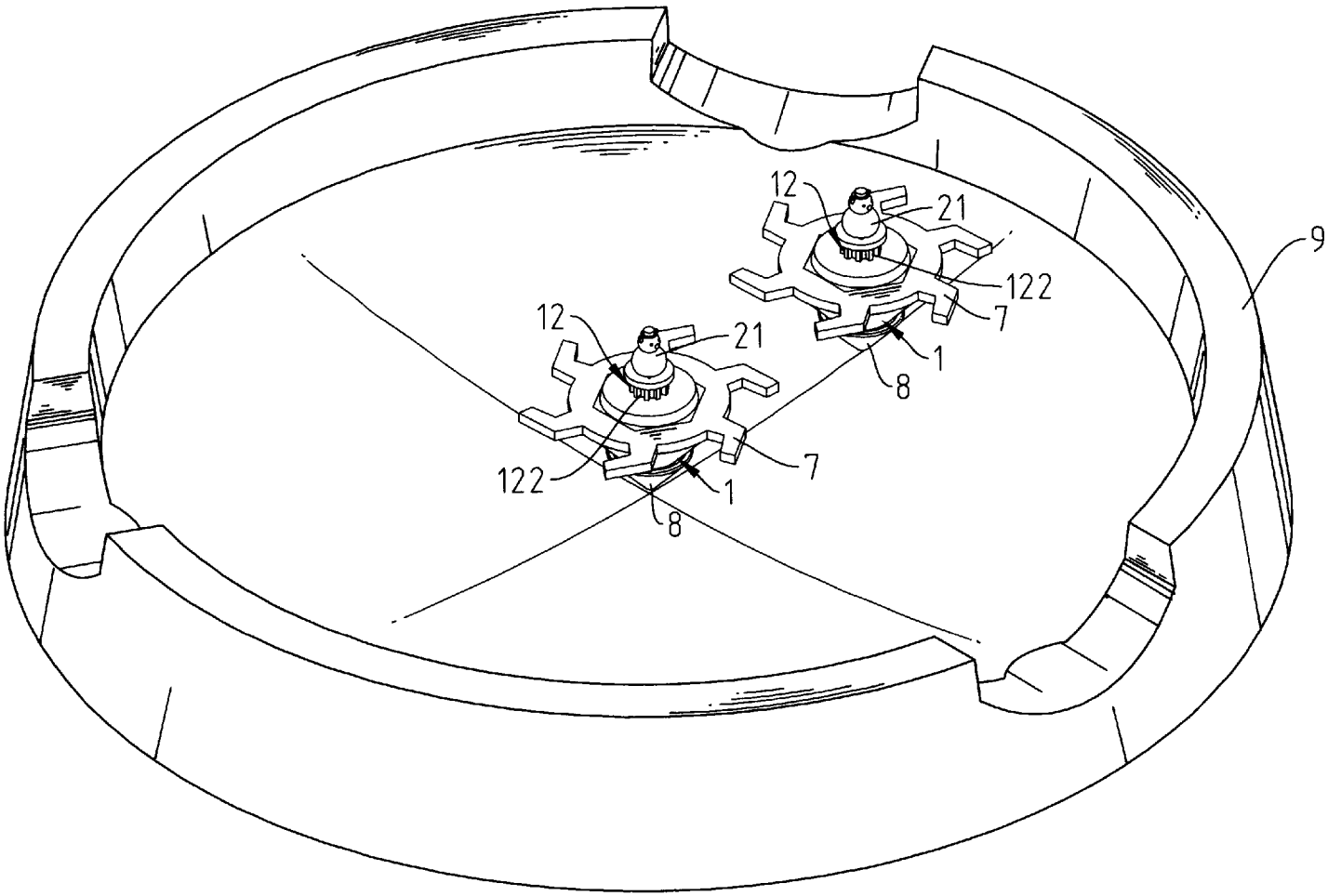
FIG. 8 is a schematic diagram of a whipping top based bubble toy of this invention in operation.

As shown in FIG. 8, it is a contest tray for a competition of whipping tops outfitted with accessories 7, 7' and counter weights 8, 8'.

What is claimed is:

1. A whipping top based bubble toy comprising: a whipping top, a fluid tube, a bracket board and a pull rod, said whipping top being of a conic taper having a central upright post and a tapered ground tip, said bracket board having a go-through vertical slot and a go-through transverse opening, an upright sleeve of said whipping top having an aperture and entering said vertical slot of said bracket board where a rack gear of the pull rod meshes with a pinion gear on said sleeve, wherein said whipping top forms a hollow vessel to be filled with bubble fluid, the upright post is multi-angular, easy to link with said sleeve, said upright post having a bottleneck with an opening to receive a fluid tube, said aperture of said sleeve being inserted over said upright post, an outer wall of said upright post has at least one male thread to receive a female thread on an inner wall of said sleeve so to secure said sleeve firmly on said upright post.

2. The whipping top based bubble toy of claim 1, wherein periphery of an upper part of said whipping top is protected by a layer of protective shield to safeguard against scratch and abrasion.

3. The whipping top based bubble toy of claim 2, wherein a hexagonal board is mounted to the whipping top to accept hexagonal accessories.

4. The whipping top based bubble toy of claim 3, wherein a concave ring is outfitted on a bottom of said whipping top to accept counter weights in order to lower whipping gravity.

* * * * *